United States Patent [19]

Theurer

[11] 4,094,250

[45] June 13, 1978

[54] MOBILE TRACK TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 669,207

[22] Filed: Mar. 22, 1976

[30] Foreign Application Priority Data

Jun. 20, 1975 Austria ..... 4773/75

[51] Int. Cl.[2] ..... E01B 27/17

[52] U.S. Cl. ..... 104/12; 104/7 R

[58] Field of Search ..... 104/7 R, 10, 12, 14

[56] References Cited

U.S. PATENT DOCUMENTS

| | | | |
|---|---|---|---|
| Re. 27,604 | 3/1973 | Stewart et al. | 104/12 |
| 3,465,688 | 9/1969 | Sauterel | 104/12 |
| 3,494,297 | 2/1970 | Plasser et al. | 104/12 X |
| 3,589,297 | 6/1971 | Plasser et al. | 104/12 |
| 3,595,170 | 7/1971 | Plasser et al. | 104/12 |
| 3,719,150 | 3/1973 | Theurer et al. | 104/12 |
| 3,762,333 | 10/1973 | Theurer et al. | 104/12 |
| 3,795,198 | 3/1974 | Plasser et al. | 104/12 |
| 3,799,059 | 3/1974 | Sieke et al. | 104/12 |

FOREIGN PATENT DOCUMENTS

| | | | |
|---|---|---|---|
| 2,426,841 | 1/1975 | Germany | 104/12 |
| 2,460,700 | 7/1975 | Germany | 104/12 |

*Primary Examiner*—Randolph A. Reese
*Attorney, Agent, or Firm*—Kurt Kelman

[57] ABSTRACT

A mobile track tamper comprises two tamping tool assembly units mounted on a machine frame for vertical movement. Each tamping tool assembly includes two pairs of vibratory tamping tools spaced from each other in the direction of track elongation so that each pair of tools may be immersed in successive cribs and the two units are so spaced that all four pairs are immersible in successive cribs. The tools of each pair are reciprocable in opposite directions towards and away from the elongated edges of adjacent ties wherebetween the cribs are defined. A common drive vertically moves the tamping tools of each unit.

12 Claims, 4 Drawing Figures

A
1
2
3(4)
5
6
7
8
9
10
11
12
13
14
17
18
19
20
21
22
23
24
25
26
27
28
29
29'
30
54
55
56
57
58
S
S1
S2
S3
S4
S5
F1
F2
F3
F4
F5
Z 3
4
10
12
15
16
17
24
28
31
32
S1
S2
S3
S4
S5
X 3
4
33
34
35
36

MOBILE TRACK TAMPING MACHINE

The present invention relates to a mobile track tamping machine for substantially simultaneously tamping ballast underneath successive track ties resting on the ballast. Such ties have elongated edges extending transversely of the track and two ends extending in the direction of the track, the elongated edges of adjacent ones of the ties defining cribs therebetween.

U.S. Pat. Nos. 3,357,366, dated Dec. 12, 1967, and 3,372,651, dated Mar. 12, 1968, disclose highly successful, high-quality tampers with a tamping assembly designed for the simultaneous tamping of two ties. The tamping assembly comprises two pairs of tamping tools which effectuate a pincer movement for tamping ballast under each tie, the tamped ties being positioned between the tools of each pair. Attempts to use more than one such tamping assembly in an effort to tamp more than two adjacent ties simultaneously have encountered difficulties because the operator has found it hard to center the tamping tools properly for immersion in the ballast and thus to avoid damage to the ties. Further problems have included the structural arrangement of the tamping tools in combination with track correction units and their associated reference systems, as well as additional ballast tampers that are often found desirable.

In German Offenlegungsschrift (Published Application) No. 2,426,841, published Jan. 2, 1975, there is disclosed a mobile track tamping machine with two independently vertically movable tamping tool assemblies. Each tamping tool assembly includes a pair of vibratory tamping tools spaced from each other in the direction of the track so that each pair of tools is in vertical alignment with a respective one of successive cribs, and a single tamping tool spaced from the pair of tools so that it is in vertical alignment with an adjacent crib whereby the tamping tools may be immersed in four cribs upon simultaneous vertical downward movement of the tamping tool assemblies. This arrangement requires a pair of tools to be immersed at each intermittently proceeding tamping step in a crib in which a single tool was immersed in the preceding step and, additionally, provides an uneven and irregular ballast compaction over a long stretch of track because of the difference in the number of tamping tools immersed in adjacent cribs. Even more disadvantageous is the fact that the operator has difficulty in clearly observing the immersion of the tools in four cribs so that the descending tamping tools will cause damage to any tie in the path of the vertically downward moving tool. The operation is relatively slow and the construction is complex, particularly in combination with the drives for vertical moving, reciprocating and vibrating the tamping tools, and is correspondingly subject to frequent break-downs.

It has also been proposed to tamp several ties substantially simultaneously in a single operation in so-called tandem tamping wherein two intermittently advancing tamping machines are used in succession. This requires two machines and their operating personnel, and has the additonal disadvantage of making it difficult quickly and with assurance to note the ties to be tamped. Also known are machines on which two tamping tool assemblies are spaced apart on a common frame or on two frames which are coupled together, such as shown in U.S. Pat. No. 3,595,170, which avoid the disadvantage of using two separate machines. However, it is generally and fundamentally disadvantageous in the tamping and leveling of track, particularly where high-speed train traffic is involved, to leave a space between two tamping tool assemblies, which space is worked later, even during the same operating step. In such an operation, difficulties are also often encountered in obtaining the proper length of advancement of the machine between the successive tamping steps.

U.S. Pat. No. 2,497,682, dated Feb. 14, 1950, discloses a ballast tamper on which a series of six, seven or more vertically movable wedge-like tamping tools are mounted, if desired, for movement in the direction of the track for adjustment to differences in the tie spacing. The tools may be lowered into adjacent cribs and the pair of tamping plates on each tool is spread in an attempt to press the ballast against the adjacent ties. Such a machine has not been in practical use because its construction is exceedingly complex and tamping of the ballast underneath the ties is very difficult to achieve because of the wedge shape of the tamping tools and the lack of vibration, the disclosed nature of the tools being such that even the penetration of such a plurality of tools into the ballast is very difficult to achieve. In addition, centering of each tool in a respective crib would slow down the work beyond the operating efficiency demanded from present-day automatic tampers.

In my copending application Ser. NO. 669,208, filed concurrently and entitled "Mobile Track Tamping Machine", I have disclosed simultaneous tamping of three ties. Pertinent portions of this application are incorporated herein by way of reference.

It is the primary object of this invention to provide a mobile track tamping machine for substantially simultaneously tamping ballast underneath four or more immediately adjacent ties in a single step while avoiding the disadvantages inherent in conventional machines and using essentially the same tamping operation, particularly as far as reciprocation of the tamping tools is concerned, for all tamped ties. In this manner, the ballast from all worked cribs is more uniformly distributed underneath the adjacent ties so as to improve the tamping quality and to obtain enhanced operating efficiency, taking also into account the capacity of an operator to handle the entire operation.

The above and other objects are accomplished in accordance with the invention with a mobile track tamping machine which comprises a machine frame and two tamping tool assembly units mounted on the machine frame for vertical movement. Each tamping tool assembly unit is a structural unit including two pairs of vibratory tamping tools spaced from each other in the direction of the track. The spacing is such that each pair of tools is in vertical alignment with a respective one of two successive cribs whereby the tamping tools of each pair may be immersed in the respective crib upon vertical downward movement of the unit. The tamping tools of each pair are reciprocable in opposite direction towards and away from a respective one of the elongated edges of an adjacent tie. The unit further includes a drive for vibrating the tamping tools, a drive for reciprocating the tamping tools and a common drive for vertically moving the tamping tools. The two tamping tool assembly units are spaced from each other in the direction of the track so that the tamping tools may be immersed in four successive cribs upon the vertical movement of the units.

In my concurrently filed application of the same title, I disclosed and claimed a single such tamping tool assembly unit on a mobile track tamping machine.

With a machine of such structure, like pairs of tamping tools are immersed in four successive cribs, thus producing a continuous track section of uniform ballast compaction under the adjacent ties, the work of the vibratory double tools, in conjunction with their reciprocation, leading to an increased ballast compaction and thus providing more stable support for the track ties. At the same time, the control by the operator is much simplified since each unit need to be lowered only in alignment of its tamping tool pairs in two successive cribs, centering of the tamping tool pairs being effected readily in respect of the intermediate tie. The independent vertical movement of the two tamping tool assembly units facilitates the operation not only in connection with tamping but also other track work, and makes it possible readily to adapt to various track conditions.

The above and other objects, advantages and features of the present invention will become more apparent from the following detailed description of certain now preferred embodiments thereof, taken in conjunction with the generally schematic drawing wherein FIG. 1 is a side elevational view of a mobile track tamping machine according to one embodiment of this invention;

Figure 1:
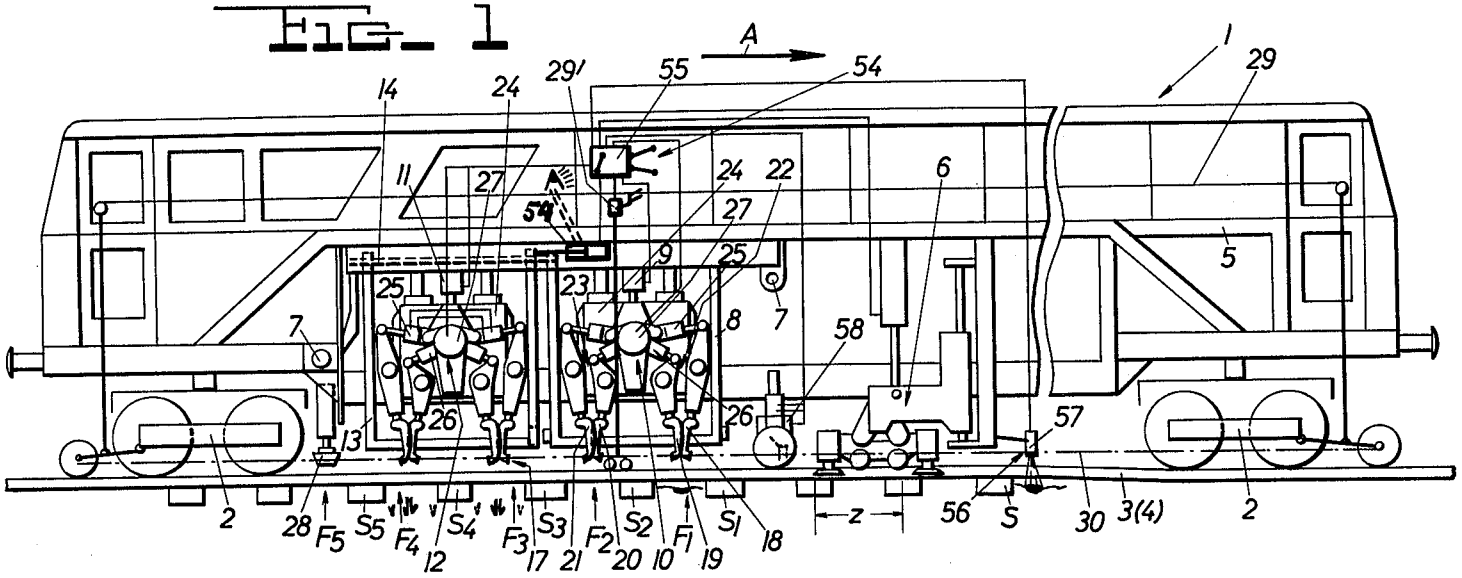

Referring now to the drawing and first to FIG. 1, there is shown a combined mobile track tamping, leveling and lining machine 1 comprising machine frame 5 mounted for mobility on tracks rails 3, 4 on undercarriages 2, 2 for intermittent advancement in the direction of operation indicated by horizontal arrow A. Combined track lifting and lining unit 6 of generally conventional structure is mounted on frame 5 between the undercarriages.

Two tamping tool assembly units 10 and 12, each constituting a structural unit, are mounted on machine frame 5 for vertical movement. Carrier frame 8 is mounted on machine frame 5 for movement transversely of the track on two guide beams 7, 7 affixed to frame 5 and extending transversely thereof. The two pairs 22, 23 of tamping tools 18, 19 and 20, 21 of forward tamping tool assembly unit 10, as viewed in the direction of operation A, are mounted on carrier 24 which is vertically movably mounted on vertical guide columns affixed to carrier frame 8. Hydraulic motor drive 9 for vertically moving the forward unit is also mounted on this carrier frame. On the other hand, the two pairs of tamping tools of rear tamping tool assembly unit 12 are mounted on carrier 24 which is vertically movably mounted on vertical guide columns affixed to intermediary carrier 13. Carrier frame 8 has affixed thereto elongated horizontal guide rails 14 extending in the direction of the track and carrier 13 is mounted on these guide rails for movement in relation to carrier frame 8 and machine frame 5 by means of hydraulic motor drive 54 mounted on carrier frame 8. This arrangement is particularly advantageous because it enables the adjustment of the two tamping tool assembly units to be effected in a very simple manner for adaptation to different average tie spacings or irregular tie spacings.

Figure 2:
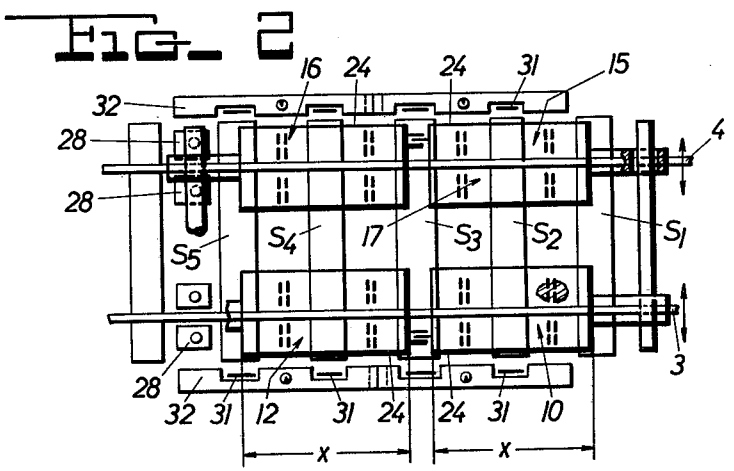
FIG. 2 is a schematic top view of the two tamping tool assembly units of FIG. 1 and the track section on which they work.

The two units 10 and 12 are identical in structure and are associated with rail 3, while like units 15, 16 are associated with rail 4, as shown in FIG. 2, like reference numerals designating like parts operating in a like manner in all tamping tool assembly units. Each unit has an independent drive 9, 11 for vertically moving the unit and also independently operable drives for reciprocating the tamping tools of each pair. While the independent operation of these drives may be controlled from a central operating station, it is frequently advantageous to operate them individually. While the drives may be operated together on a well aligned track designed for high-speed traffic and using concrete ties, for instance, it may be preferable to lower the units one after the other into a badly encrusted ballast bed in an effort to overcome the ballast resistance against penetration by the tools more readily. Furthermore, this independent operation makes it possible to work only with one unit where this is indicated by the specific nature of a particular track section.

As has been schematically indicated at 24 in FIG. 2, forward units 10, 15 may be coupled with rear units 12, 16 so that they may be transversely moved along cross beams 7, 7 together.

Each tamping tool assembly 17 comprises two pairs 22, 23 of tamping tools 18, 19 and 20, 21 which are spaced from each other in the direction of the track. The spacing is such that each pair of tools is in vertical alignment with a respective one of two successive ones of cribs $F_1$, $F_2$, $F_3$ and $F_4$ whereby the tamping tools 18, 19 and 20, 21 of each pair 22, 23 may be immersed in the respective crib upon vertical downward movement of the unit. The tamping tools of each pair are reciprocable in opposite directions towards and away from a respective one of the elongated edges of an adjacent tie $S_1$, $S_2$, $S_3$, $S_4$ and $S_5$. To enable unhindered vertical movement of the tamping tool assembly units, the elongation X of the unit carrier frames 8 and 13 is equal to or smaller than the sum of two average spacings Z between adjacent ties. With such dimensioning, all four pairs 22, 23 of tamping tools may be readily immersed in the ballast cribs and reciprocated to tamp ballast underneath ties $S_1$ to $S_5$.

The tamping tools are journaled in carriers 24 intermediate their ends for pivoting about transversely extending axes. The upper ends of the respective tamping tools 18, 19 and 20, 21 are linked by hydraulic motors 25, 26 to vibrating drive 27 arranged centrally between the pairs 17 of tamping tools. Drive 27 is a conventional eccenter shaft drive used widely in this art. Such a tamping tool vibrating and reciprocating drive constitutes a particularly simple structure and has the advantage of making all parts readily replaceable, similar drives having been used in conventional track tampers so that their components may be used or readily adapted for the present machine. The arrangement is readily usable for the well known asynchronous tamping which produces high quality ballast compaction.

Four surface tampers 28 are mounted on machine frame 5 for compacting the ballast in crib $F_5$ behind a last one of the tamping tools in the operating direction of movement of the machine, thus assuring proper tamping of tie $S_5$ in cooperation with this last reciprocatory tamping tool.

The illustrated machine also includes a conventional track leveling and lining system, including leveling reference 29 and lining reference 30 which survey the track position and control the track lifting and lining unit 6. Such track surfacing being well known and forming no part of the present invention, it will not be described herein. As shown in FIG. 1, unit 6 is mounted on machine frame 5 frontward of forward tamping tool assembly unit 10, as viewed in the operating direction of movement of the machine, and track grade control signal emitter 29' is arranged in the range of forward unit 10 to cooperate with reference line 29 for controlling the track lifting.

The top view of FIG. 2 clearly shows the position of the tamping tool pairs 22,23 in relation to ties $S_1$ to $S_5$ and also shows the arrangement of surface tamper 32 adjacent the ends of the ties and extending over the two tamping tool assembly units, the tamper body being vibrated and carrying individual tamping tools 31 adjacent each tie end and reciprocable towards and away from the tie ends. Such surface tampers are known and the illustrated arrangement could be replaced by individual vibratory and reciprocatory tamping tools mounted adjacent each tie end.

Figure 3:
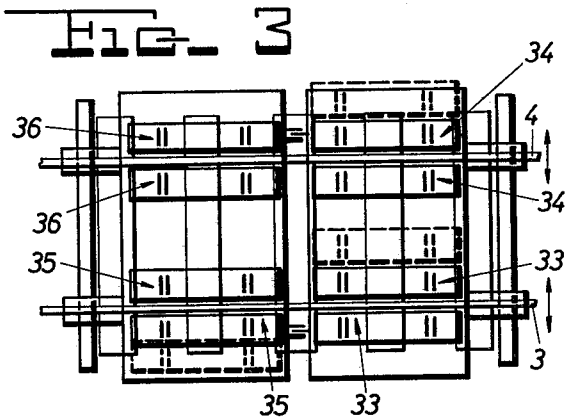
FIG. 3 is a like top view of two modified tamping tool assembly units.

In the modified arrangement of FIG. 3, two independent structural tamping tool assembly units 33, 34, 35, 36 are associated with each track rail 3, 4. As indicated in broken lines in connection with some of these units, each unit has its own drive for vertically and transversely moving the same, and drives may also be provided to move each unit, or some of the units, in the direction of the track, to provide universal adjustability of the tamping tool pairs in adaptation to all track configurations, including track curves, switches and the like.

Figure 4:
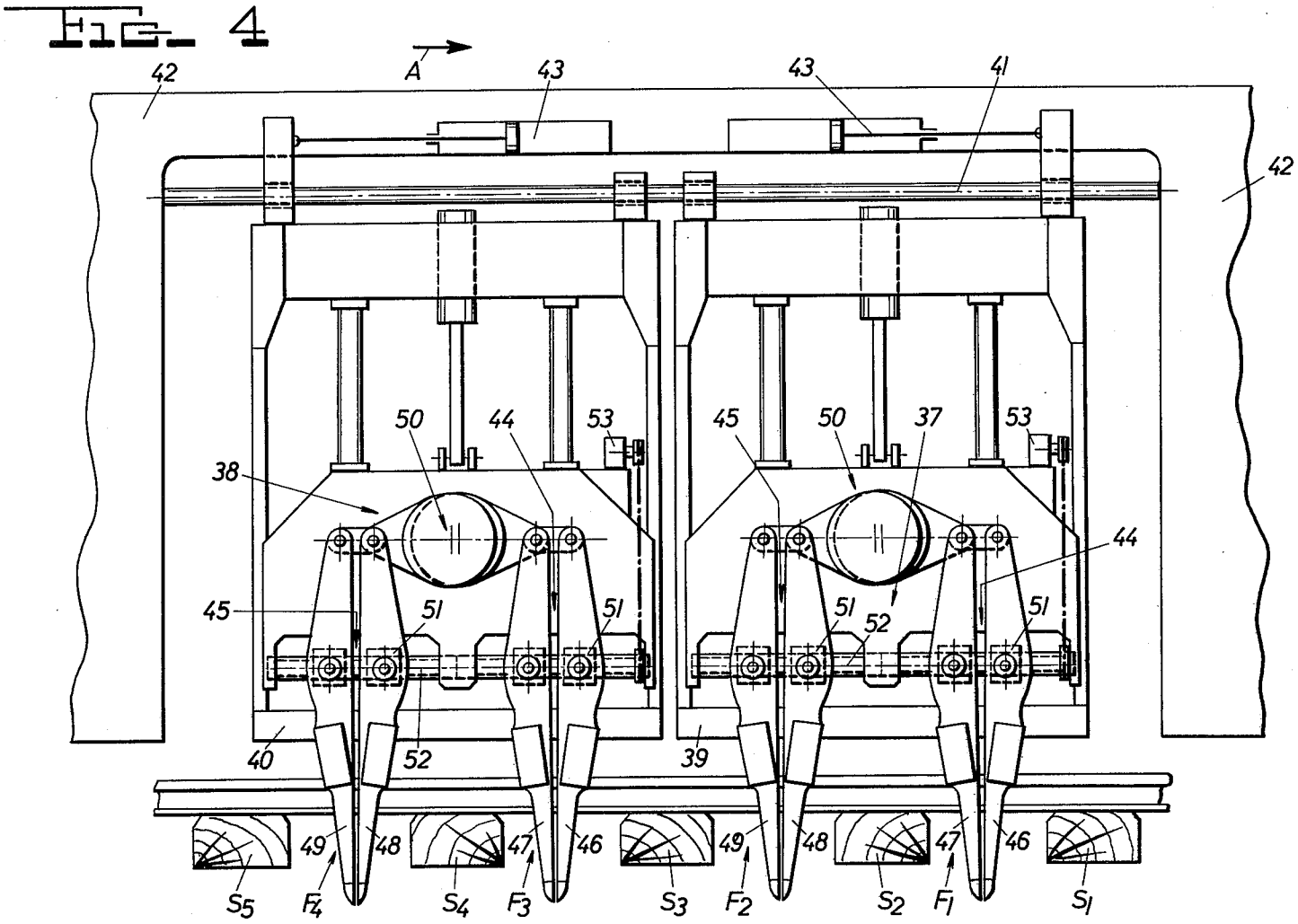
FIG. 4 is an enlarged side elevational view of another embodiment of two tamping tool assembly units with a mechanical drive for reciprocating the tamping tools of each pair.

In the embodiment of FIG. 4, each tamping tool assembly unit 37, 38 is mounted in its own carrier frame 39, 40 and the carrier frames are mounted for movement in the direction of the track on guide beam 41 which extends in this direction and is affixed to machine frame 42. Hydraulic motor drives 43 are arranged on the machine frame for moving the carrier frames and the tamping tool assembly units supported thereby in this direction. This arrangement enables the tamping tool assembly units to be centered over respective cribs $F_1$ and $F_4$ individually in the operating direction indicated by arrow A, which is very useful in track sections with highly irregular tie spacings. The two units are again identical and comprise pairs 44 and 45 of tamping tools 46, 47 and 48, 49. The upper end of each tamping tool is linked to eccenter shaft drive 50 for vibrating the tools, the tools of each pair being connected to the same arm of the vibratory drive. In this manner, the tools of each pair are vibrated synchronously but in the opposite direction as the tools of the other pair of each unit. Such a vibratory movement is particularly useful in providing good and uniform ballast tamping.

The reciprocating drive shown in FIG. 4 serves for synchronous tamping. It comprises threaded spindle 52 and a pair of nuts 51, 51 threadedly engaging the spindle which is rotatably journaled in a carrier for the tamping tools. Each nut is affixed to a respective tamping tool of each pair intermediate the ends thereof, and the spindles are rotated by chain drive 53 or the like.

In the embodiments, the vibratory drives for both tamping tool assembly units may be synchronized so that the adjacent pairs of tamping tools vibrate in counterphase while the tamping tools of each pair vibrate in phase.

However, as indicated in FIG. 1, it is also possible to connect the tamping tools of each pair to a separate arm of the vibratory drive so that the tamping tools of each pair vibrate in counterphase, as do the opposite tools of adjacent pairs. With such a vibratory arrangement, in which adjacent tools vibrate in opposite directions, it is useful, as shown in FIG. 1, if at least the lower parts of tamping tools 18 to 21 are somewhat offset from each other in a direction transverse to the track and, in the direction of the track, have offset portions spacing these portions apart, as more fully described in U.S. Pat. No. 3,429,276, dated Feb. 25, 1969.

In the operation of the above-described machine, the simultaneous immersion of pairs of vibratory tamping tools in four successive cribs $F_1$ to $F_4$ causes a relatively large volume of ballast fairly deep in the cribs to be displaced by pressure and vibration towards the longitudinal edges of the adjacent ties, and this compaction of the ballast is further enhanced and transmitted to the zone below the ties by the reciprocation of the vibratory tamping tools. This produces large and uniformly compacted ballast supports for ties $S_1$ to $S_5$. It is a further advantage of this arrangement that the identical volume constituted by the bodies of the tamping tools penetrates into each crib and just once. This prevents previously compacted ballast from being loosened again by later immersion of tamping tools into the same crib, thus assuring unusually high uniformity of compaction and a correspondingly solid track bed.

The drives for the tamping tools, the intermittent advancement of the machine and the track correction may be effectively controlled from central operating station 54 which is advantageously positioned on the machine frame above the tamping tool assembly units. This station comprises console 55 from which the hydraulic fluid flow for all the operating drives may be controlled by an operator who may, at the same time, also handle the controls for track correction unit 6.

Since the track tamping machine must be advanced from tamping station to tamping station by a length corresponding to four cribs, a signaling means is provided on the machine to indicate the length of each forward movement which, as indicated hereinabove, corresponds to four times spacing Z between two adjacent ties, as measured from the center lines of the ties. The illustrated signaling means is a paint spray device 57 arranged on machine frame 5 at a spacing from the front tamping tool pair corresponding to the desired forward movement, i.e. four times the distance Z. While the signaling means has been shown to emit an optical indicating signal, an acoustical or other indicating signal may be emitted from such a signaling means. In this arrangement, the operator at central station 54 sprays paint on the ballast, preferably around one of the track rails, so as to indicate the crib in which the front tamping tool pair is to be immersed in the succeeding tamping step. Preferably and as illustrated, this signaling means is combined with an odometer or tie counting device 58. This makes it possible for the operator very quickly and accurately center the tamping tools in the proper cribs and this considerably increases the efficiency of the machine.

It will be understood by those skilled in the art that the machine of the present invention is not limited to the illustrated and described specific embodiments and that the various drives may be operated not only hydraulically and mechanically but also electrically in any desired combination. Also, various means for vibrating the tamping tools and various types of such tools may be used without departing from the spirit and scope of this invention as defined by the claims.

I claim:

1. A mobile track tamping machine for substantially simultaneously tamping ballast underneath five successive track ties resting on the ballast, the ties having elongated edges extending transversely of the track and two ends extending in the direction of the track, the elongated edges of adjacent ones of the ties defining cribs therebetween, which comprises (a) a machine frame; and (b) two like tamping tool assembly units mounted on the machine frame for vertical movement, each tamping tool assembly unit being a structural unit including (1) a carrier for the tamping tools mounted on the machine frame for vertical movement and adjustably spaced from each other in the direction of the track, (2) no more than four tamping tools immersible in the ballast and arranged on the carrier in two like pairs of vibratory tamping tools spaced from each other in the direction of the track, the spacing being such that each pair of tools is in vertical alignment with a respective one of two successive ones of the cribs whereby the tamping tools of each pair may be immersed in the respective crib upon vertical downward movement of the carrier, (3) a pivot mounting each one of the tamping tools on the carrier for reciprocation of the tamping tools of each pair in opposite directions towards and away from a respective one of the elongated edges of an adjacent one of the ties, the pivots of each of the pairs of tamping tools being spaced from each other in the track direction less than one crib width, and the pairs of tamping tools having tamping jaws for immersion in the ballast whose closest spacing in the track direction is smaller than the average size of the ballast, (4) a common drive for vibrating the two pairs of tamping tools arranged on the carrier centrally with respect to the pairs of tamping tools, (5) a drive for independently reciprocating each of the tamping tools about their pivots, and (6) a drive arranged centrally with respect to the pairs of tamping tools for vertically moving the carrier with the tamping tools;

(c) the spacing of the tamping tool assembly unit carriers being such that the pairs of tamping tools may be immersed in four successive ones of the cribs upon the vertical movement of the carriers.

2. The mobile track tamping machine of claim 1, wherein at least one of the tamping tool assembly unit carriers is mounted on the machine frame for movement in the direction of the track.

3. The mobile track tamping machine of claim 2, wherein the one tamping tool assembly unit carrier is the rear unit, as viewed in the operating direction of movement of the machine.

4. The mobile track tamping machine of claim 1, further comprising means for independently operating the drives for reciprocating each of the tamping tools and the common drive of each unit, and a central operating station for controlling the operating means.

5. The mobile track tamping machine of claim 1, further comprising tamper means arranged for compacting the ballast in the crib behind a last one of the tamping tools in the operating direction of movement of the machine, the rear tamping tool assembly unit, as viewed in the operating direction, being mounted on the machine frame for movement in the direction of the track, and the tamping means being arranged for common movement in said direction with the rear unit.

6. The mobile track tamping machine of claim 1, further comprising a track correction unit mounted on the machine frame frontward of a forward one of the tamping tool assembly units, as viewed in the operating direction of movement of the machine, and track correction means cooperating with the track correction unit.

7. The mobile track tamping machine of claim 6, wherein the track correction means comprises a reference system including a track grade indicating element in the range of the forward unit.

8. The mobile track tamping machine of claim 6, further comprising a signaling means for indicating the length of intermittent forward movements of the machine, the length corresponding to four times the average distance between the center lines of adjacent ties.

9. The mobile track tamping machine of claim 8, wherein the signaling means is arranged to emit an optical indicating signal.

10. The mobile track tamping machine of claim 9, further including a tie counting device and the signaling means associated therewith is a paint spray device.

11. The mobile track tamping machine of claim 9, further including an odometer and the signaling means associated therewith is a paint spray device.

12. The mobile track tamping machine of claim 1, wherein the combined dimension of the two tamping tool assembly units in the direction of track elongation does not exceed four times the average distance between the center lines of adjacent ties.

* * * * *